United States Patent [19]

Spencer et al.

[11] Patent Number: 4,882,893

[45] Date of Patent: Nov. 28, 1989

[54] CONTAINER FOR THE TRANSPORT OF DIAGNOSTIC SPECIMENS

[76] Inventors: Herbert C. Spencer, R.R. #1, Millet, Alberta, Canada, T0C 1Z0; James G. McKay, 2003, 11507 - 124 Street, Edmonton, Alberta, Canada, T5M 0K5

[21] Appl. No.: 237,966

[22] Filed: Aug. 29, 1988

[30] Foreign Application Priority Data

Feb. 26, 1988 [CA] Canada ..... 559969

[51] Int. Cl.[4] ..... B65B 23/22; B65B 11/58; B65B 5/10

[52] U.S. Cl. ..... 53/449; 53/465; 53/472; 53/475

[58] Field of Search ..... 53/449, 461, 465, 472, 53/475

[56] References Cited

U.S. PATENT DOCUMENTS

| | | | |
|---|---|---|---|
| 2,283,867 | 5/1942 | Flosdorf et al. | 53/449 X |
| 2,624,989 | 1/1953 | White | 53/449 X |
| 2,780,350 | 2/1957 | Simon et al. | 53/449 X |
| 3,398,501 | 8/1968 | Aninger | 53/472 X |
| 3,500,996 | 3/1970 | Gorman . | |
| 3,581,883 | 6/1971 | Whitney . | |
| 3,667,593 | 6/1972 | Pendleton | 53/472 X |
| 3,710,539 | 1/1973 | Cothran et al. | 53/449 |
| 3,750,871 | 8/1973 | Cook . | |
| 3,893,280 | 7/1975 | King | 53/449 X |
| 3,992,849 | 11/1976 | Lett, III | 53/449 |
| 4,501,360 | 2/1985 | Levy | 206/443 |
| 4,640,080 | 2/1987 | Wright | 53/472 X |
| 4,793,123 | 12/1988 | Pharo | 53/449 |

FOREIGN PATENT DOCUMENTS

| | | | |
|---|---|---|---|
| 808464 | 3/1969 | Canada | 217/13 |

OTHER PUBLICATIONS

Transport Canada Report 7/1987.

*Primary Examiner*—Horace M. Culver
*Attorney, Agent, or Firm*—Davis, Bujold & Streck

[57] ABSTRACT

There is disclosed a method of packaging vials containing diagnostic specimens for purposes of transport. The method is comprised of the steps of: firstly, wrapping a vial in shock absorbing material; secondly, inserting the vial wrapped in shock absorbing material in a pressure vessel, the pressure vessel having moisture absorbing material lining the bottom; thirdly, wrapping the sides of the pressure vessel with a plurality of layers of cardboard; fourthly, shielding the top and bottom of the pressure vessel with a plurality of layers of cardboard; and fifthly, sealing the pressure vessel with cardboard wrap and shielding in a cardboard box.

15 Claims, 8 Drawing Sheets

CONTAINER FOR THE TRANSPORT OF DIAGNOSTIC SPECIMENS

The present invention relates to a method of packaging vials containing diagnostic specimens for purposes of transport.

BACKGROUND OF THE INVENTION

During handling and transportation packages are subjected to a variety of abuse. Often the packaging selected by the shipper is inadequate resulting in damage to the goods being transported.

One class of goods which are frequently transported are diagnostic specimens. Specimens must be sent from rural points to regional laboratories in major urban centres for testing. With some types of diseases a further specimen must be sent to national laboratories. Of the millions of diagnostic specimens transported every day, a portion are potentially infectious.

The recent outbreak of Acquired Immune Deficiency Syndrome, commonly referred to as "AIDS", has raised concerns about the adequacy of existing practises for packaging diagnostic specimens. When the diagnostic specimen being shipped is an infectious substance inadequate packaging can present a health hazard to transport company employees and the public at large. Packaging is not considered to be adequate unless it is capable of meeting the standards developed by the United Nations Committee of Experts on the Transportation of Dangerous Goods. The problem at present is that almost all known methods of packaging fail one or more of the key testing areas established by the United Nation; namely, drop testing, puncture testing or leakage testing.

SUMMARY OF THE INVENTION

One primary object of the present invention is to develop a method of packaging vials containing diagnostic specimens for purpose of transport.

Broadly, the present invention provides a method of packaging vials containing diagnostic specimens or other potentially infectious substances for purposes of transport, which is comprised of the steps of: firstly, wrapping a vial in shock absorbing material; secondly, inserting the vial wrapped in shock absorbing material in a pressure vessel, the pressure vessel having moisture absorbing material lining the bottom; thirdly, wrapping the sides of the pressure vessel with a plurality of layers of cardboard; fourthly, shielding the top and bottom of the pressure vessel with a plurality of layers of cardboard; and fifthly, sealing the pressure vessel with cardboard wrap and shielding in a cardboard box.

Another primary object of the present invention is to provide a kit of materials for packaging vials containing diagnostic specimens for purposes of transport which is cost effective.

Broadly, the present invention provides a kit of materials for packaging vials containing diagnostic specimens or other potentially infectious substances for purposes of transport, which is comprised of shock absorbing material; a pressure vessel; moisture absorbing material; cardboard wrapping material; and a cardboard box.

BRIEF DESCRIPTION OF THE DRAWINGS

These and other features of the invention will become more apparent from the following description in which reference is made to the appended drawings, wherein.

DETAILED DESCRIPTION OF THE INVENTION

There will hereinafter be described a method and a kit of materials for packaging vials containing diagnostic specimens for purposes of transport.

Figure 1:
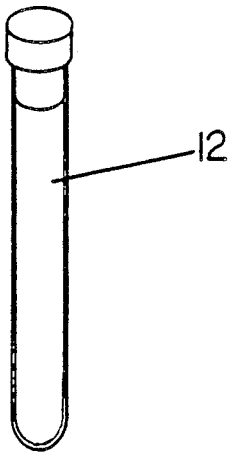
FIG. 1 is a perspective view illustrating a form of vial containing a diagnostic specimen which is protected through use of the preferred method.
Figure 2:
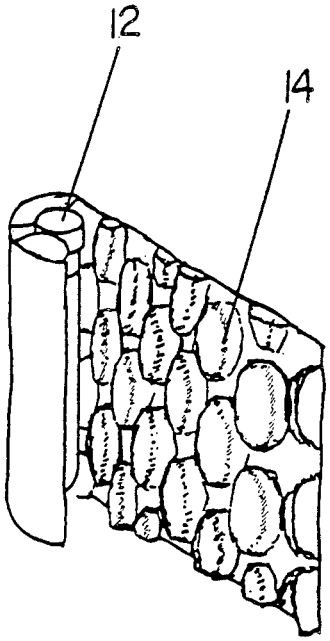
FIG. 2 is a perspective view illustrating the first step of the preferred method.
Figure 3:
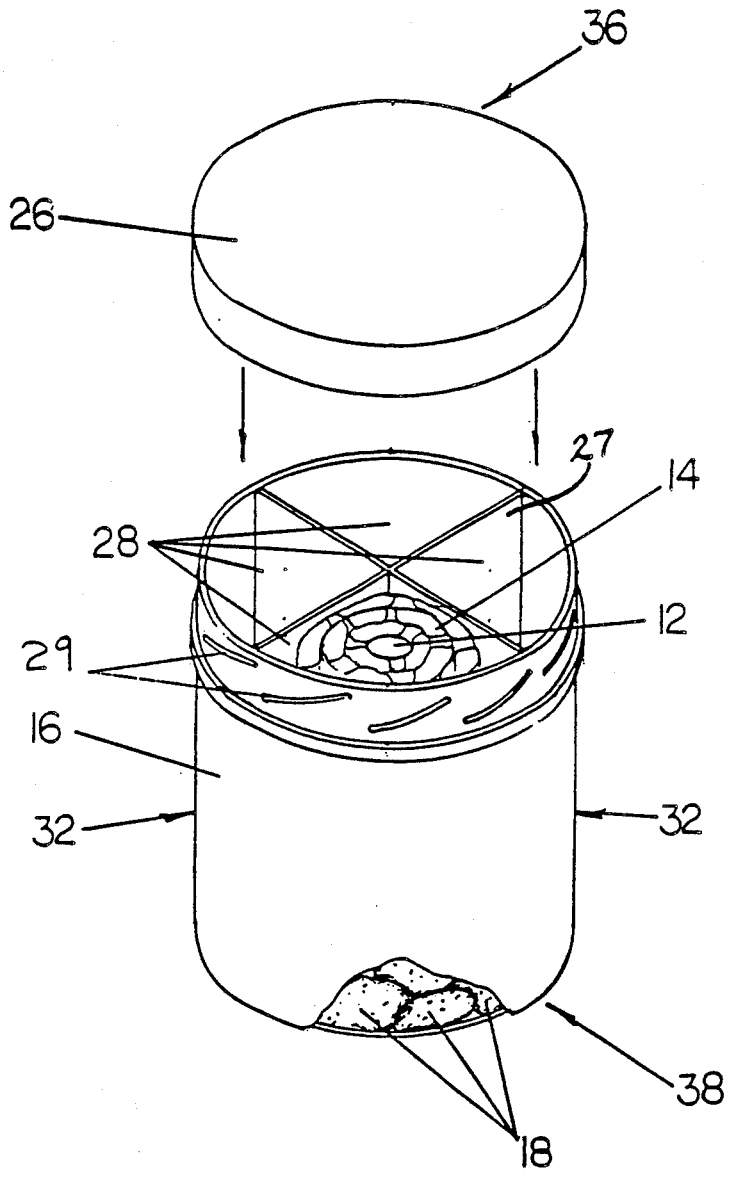
FIG. 3 is a perspective view illustrating the second step of the preferred method.
Figure 4:
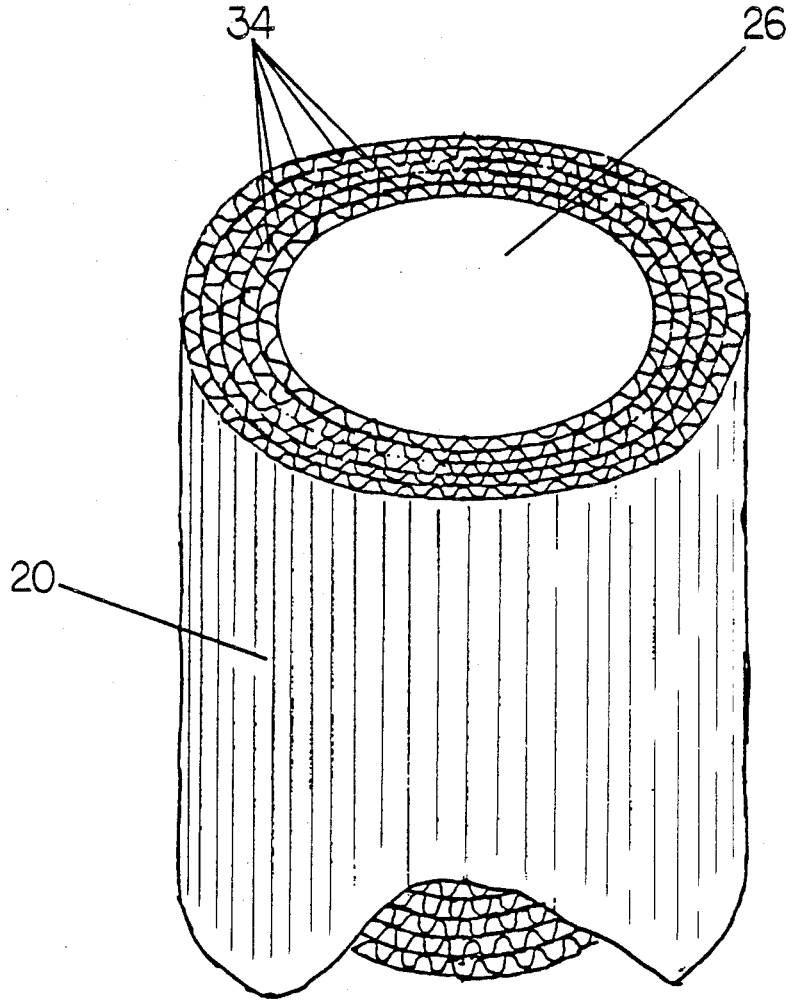
FIG. 4 is a perspective view illustrating the third step of the preferred method.
Figure 5:
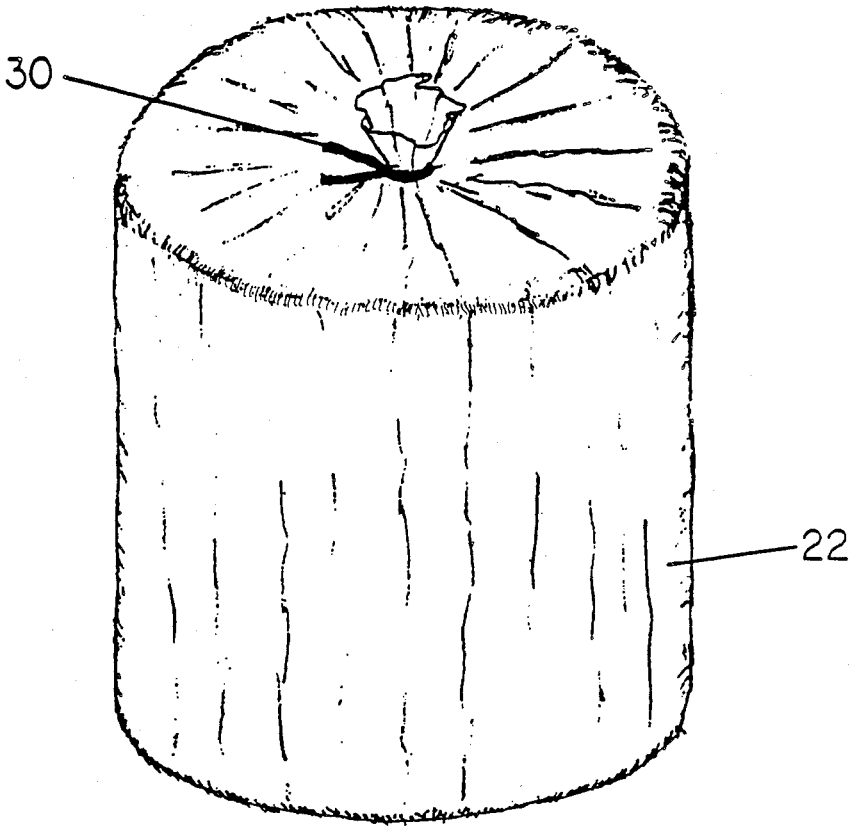
FIG. 5 is a perspective view illustrating the fourth step of the preferred method.
Figure 6:
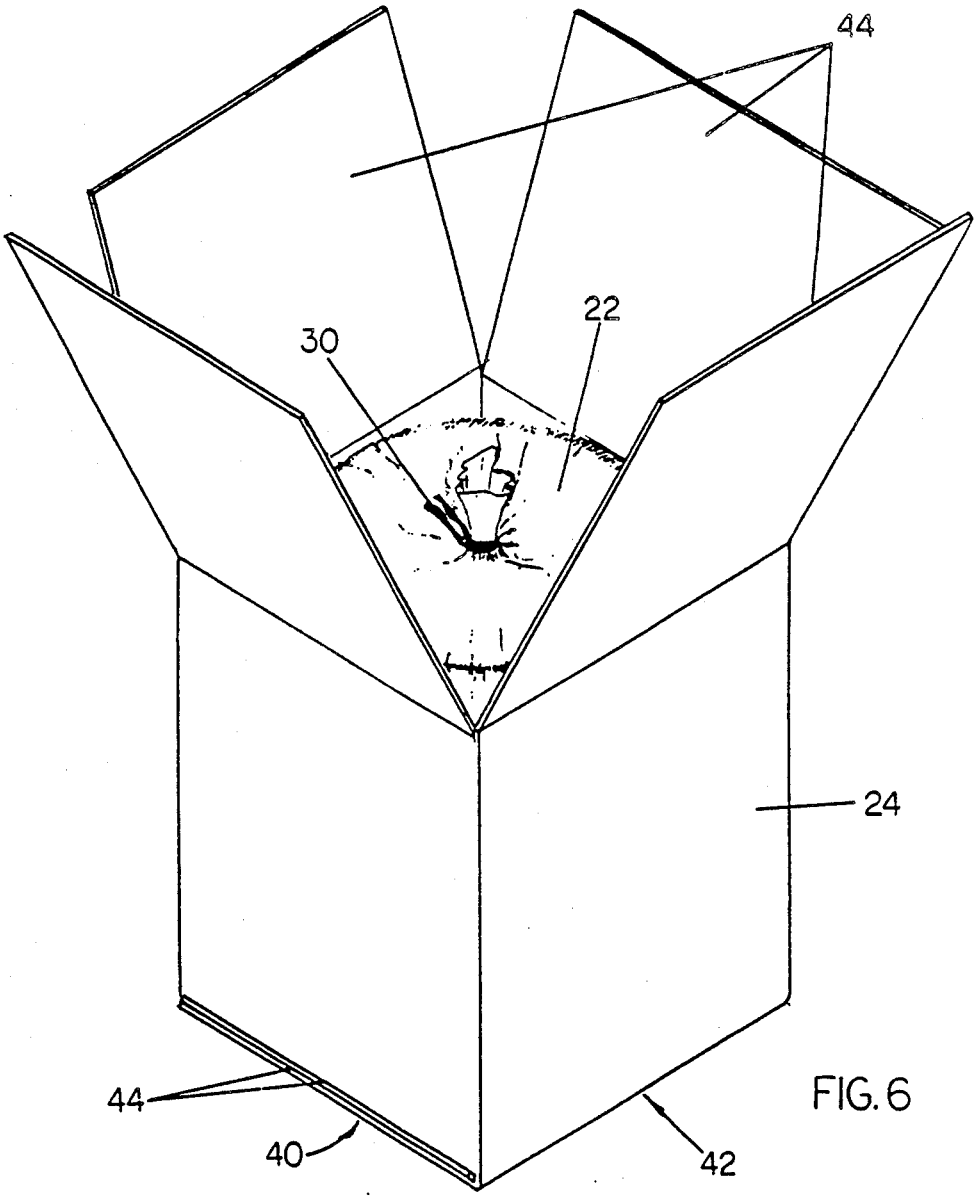
FIG. 6 is a perspective view illustrating the fifth step of the preferred method, with the closure open.
Figure 7:
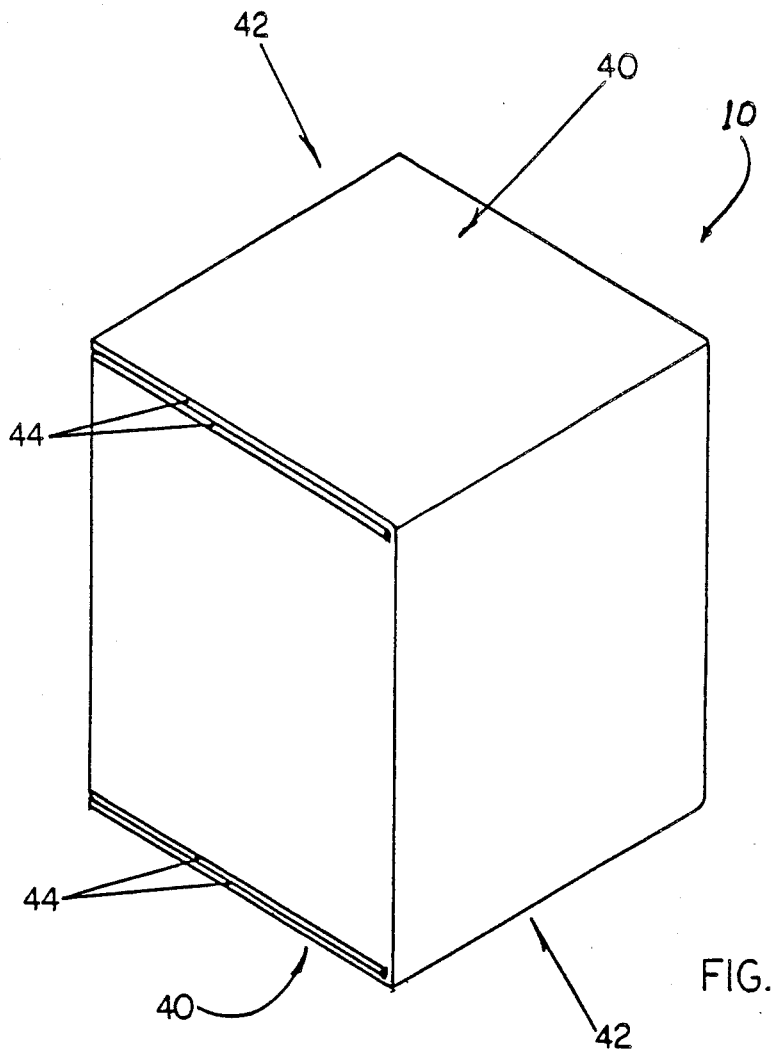
FIG. 7 is a perspective view illustrating the fifth step of the preferred method, with the closure sealed.
Figure 8:
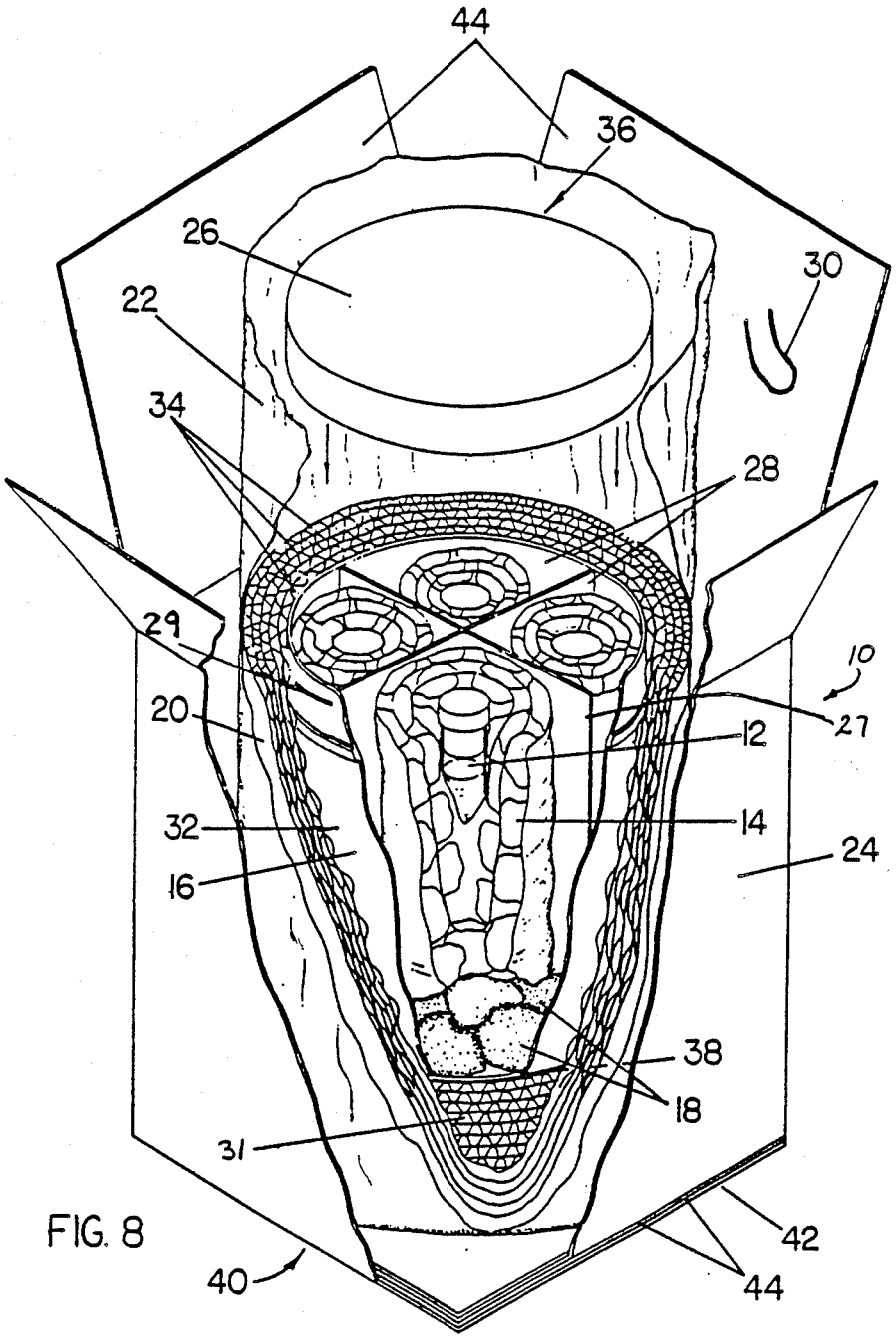
FIG. 8 is a cut-away perspective view illustrating the packaging materials.

The materials for packaging vials 12 are illustrated in FIG. 8. The packaging as a whole is generally designated by reference numeral 10. The materials illustrated are comprised of shock absorbing bubble wrap material 14, a plastic cylinder 16, cotton balls 18, cardboard wrapping material 20, a plastic bag 22, and a cardboard box 24. Plastic cylinder 16 has a closure 26. Closure 26 has a plurality of threads (not shown), which lock with mating threads 29 on plastic cylinder 16 to form a pressure tight seal. Making closure 26 of cylinder 16 pressure tight is a marked improvement over the prior art packaging, as the prior art required leakproof vials in order to pass leak testing. There are a wide variety of vials currently in use, most of which would not pass leak testing. It is envisaged that cylinder 16 must be able to withstand a pressure variation of 95 kilopascals for a minimum time duration of 10 minutes. This roughly approximates the pressure which would be exerted on the container if the cargo compartment of an airplane became depressurized during flight and the time which would be required for the airplane to descend to a lower altitude where the lack of pressurization would no longer constitute a danger. Cylinder 16 is divided into four compartments 28 by insert 29. Each compartment 28 is adapted to receive one vial 12 containing a diagnostic specimen. The fact that cylinder 16 can accommodate a plurality of specimens is an important advantage over prior art packaging. It is standard medical practise to take more than one specimen from a patient. Transporting all specimens for the patient in one container is much more cost efficient. Plastic bag 22 is closed with a watertight closure, such as twist tie 30 as illustrated. The use of one or more of plastic bags 22 with a water tight closure permits, at negligible cost, a degree of additional resistance to leakage. This additional resistance to leakage exceeds United Nations standards if a leakproof vial 12 is used.

Packaging 10 relies upon cardboard wrapping material 20 to provide the necessary resistance to the impact of dropping or puncture. Cardboard wrapping material 20 is wrapped around the sides 32 of cylinder 16 to form a plurality of layers 34. The top 36 and bottom 38 of cylinder 16 must also be shielded against impact from dropping or puncture, this is accomplished by the unique form of closure 40 for cardboard box 24 which obviates the need for additional cardboard reinforcement. Additional cardboard shielding material 31 is illustrated in FIG. 8. Cardboard shielding 31 is present primarily as filler material to prevent movement of cylinder 16, although it does provide additional impact and puncture protection. Closure 40 at each of ends 42 of cardboard box 24 is comprised of four flaps 44 each of which are substantially the same dimension as ends 42 of box 24.

A preferred method of packaging vials 12 containing diagnostic specimens for purposes of transport is hereinafter described with reference to FIGS. 1 through 8. The method uses the materials previously described, and is comprised of the following steps:

Firstly, wrapping vial 12 in shock absorbing bubble wrap material 14.

Secondly, placing cotton balls 18 as lining at the bottom (not shown) of each compartment 28 to absorb moisture due to leakage, inserting wrapped vial 12 in one of compartments 28 of plastic cylinder 16 and securing leakproof closure 26. Bubble wrap material 14 comes in a variety of sizes which is graded according to the size of the bubble. The number of layers of bubble wrap 14 required will vary with the grade used. The key factor is that the wrapping of vial 12 is sufficient to prevent movement of vial 12 within compartment 28. Vial 12 is most vulnerable to a blow on its side. Bubble wrap 14 prevents vial 12 from contacting compartment 28. Sufficient cotton balls 18, or other absorbent material, is required to absorb the entire contents of vial 12 to guard against packaging 10 receiving the force of an impact so great that the vial ruptures notwithstanding the impact protection afforded by the packaging components.

Thirdly, wrapping the sides 32 of cylinder 16 with a plurality of layers 34 of cardboard wrapping material 20. The number of layers 34 of cardboard wrapping material 20 required depends upon the grade of cardboard used. If single wall cardboard wrapping material 20 is used, a minimum of 6 layers is recommended to ensure the adequacy of impact protection.

Fourthly, inserting cylinder 16 wrapped with cardboard 20 into plastic bag 22 secured with twist tie 30.

Fifthly, sealing plastic bag 22 containing cylinder 16 with cardboard wrap 20 in cardboard box 20. Cardboard box 20 having a closure 40 at either end 42 which shields the top 36 and bottom 38 of cylinder 16 with a plurality of layers 34 of cardboard material. Closure 40 is comprised of four flaps 44 each of which are substantially the same dimension as ends 42 of cardboard box 24. It is desirable that all components be tightly confined within cardboard box 24. Additional layers 34 of cardboard wrapping material 20 and additional shielding material 31 should be used as required to ensure that cylinder 16 is tightly confined.

It will further be apparent to one skilled in the art that there are alternative shock absorbing materials available to bubble wrap and alternative moisture absorbing materials available to cotton balls. It will be apparent to one skilled in the art that cardboard box 24 need not have special closure 40, if a plurality of layers 34 of cardboard wrapping material 20 are inserted adjacent top 36 and bottom 38 of cylinder 16 to shield cylinder 16 from impact due to dropping or puncture. It will finally be apparent to one skilled in the art that the materials used in this packaging system are all readily available and inexpensive.

The embodiments of the invention in which an exclusive property or privilege is claimed are defined as follows:

1. A method of packaging vials containing diagnostic specimens for purposes of transport, comprising the steps of:

a. firstly, wrapping a vial in shock absorbing material;
b. secondly, inserting said vial wrapped in shock absorbing material in a pressure vessel, said pressure vessel having moisture absorbing material lining the bottom;
c. thirdly, wrapping the sides of said pressure vessel with a plurality of layers of cardboard;
d. fourthly, shielding the top and bottom of said pressure vessel with a plurality of layers of cardboard; and
e. fifthly, sealing said pressure vessel with cardboard wrap and shielding in a cardboard box.

2. The method as defined in claim 1, said pressure vessel being a plastic cylinder with a pressure tight closure.

3. The method as defined in claim 2, said shock absorbing material being bubble wrap.

4. The method as defined in claim 2, said moisture absorbing material being cotton balls.

5. The method as defined in claim 2, said cardboard box having a closure at either end which shields the top and bottom of said cylinder with a plurality of layers of cardboard, said closure being comprised of four flaps each of which are substantially the same dimension as the end of said box.

6. The method as defined in claim 2, said cylinder being divided into a plurality of compartments by a removable insert, each of said compartments being adapted to receive one vial containing a diagnostic specimen.

7. The method as defined in claim 1, said pressure vessel being able to withstand a pressure of 95 kilopascals for a minimum time duration of 10 minutes.

8. A method of packaging vials containing diagnostic specimens for purposes of transport, comprising the steps of:

a. firstly, wrapping a vial in shock absorbing material;
b. secondly, inserting said vial wrapped in shock absorbing material in a pressure vessel, said pressure vessel having moisture absorbing material lining the bottom;
c. thirdly, wrapping the sides of said pressure vessel with a plurality of layers of cardboard;
d. fourthly, shielding the top and bottom of said pressure vessel with a plurality of layers of cardboard;
e. fifthly, inserting said pressure vessel wrapped and shielded with cardboard into a plastic bag with a water tight closure; and
f. sixthly, sealing said pressure vessel with cardboard wrap and shielding in a cardboard box.

9. A method of packaging vials containing diagnostic specimens for purposes of transport, comprising the steps of:

a. firstly, wrapping a vial in shock absorbing material;
b. secondly, inserting said vial wrapped in shock absorbing material in a pressure vessel; said pressure vessel having moisture absorbing material lining the bottom;
c. thirdly, inserting said pressure vessel into a plastic bag with a water tight closure;
d. fourthly, wrapping the sides of said pressure vessel with a plurality of layers of cardboard;

e. fifthly, shielding the top and bottom of said pressure vessel with a plurality of layers of cardboard; and f. sixthly, sealing said pressure vessel with cardboard wrap and shielding in a cardboard box.

10. A method of packaging vials containing diagnostic specimens for purposes of transport, comprising the steps of:

a. firstly, wrapping a vial in shock absorbing bubble wrap material;

b. secondly, inserting said wrapped vial in a plastic cylinder with a pressure tight closure, said cylinder having moisture absorbing material lining the bottom;

c. thirdly, wrapping the sides of said cylinder with a plurality of layers of cardboard; and d. fourthly, sealing said cylinder with cardboard wrap in a cardboard box, said cardboard box having a closure at either end which shields the top and bottom of said cylinder with a plurality of layers of cardboard, said closure being comprised of four flaps each of which are substantially the same dimension as the end of said box.

11. The method as defined in claim 10, said moisture absorbing material being cotton balls.

12. The method as defined in claim 10, said cylinder being divided into a plurality of compartments by a removable insert, each of said compartments being adapted to receive one vial containing a diagnostic specimen.

13. The method as defined in claim 10, said closure of said cylinder being able to withstand a pressure of 95 kilopascals for a minimum time duration of 10 minutes.

14. A method of packaging vials containing diagnostic specimens for purposes of transport, comprising the steps of:

a. firstly, wrapping a vial in shock absorbing bubble wrap material;

b. secondly, inserting said wrapped vial in a plastic cylinder with a pressure tight closure, said cylinder having moisture absorbing material lining the bottom;

c. thirdly, wrapping the sides of said cylinder with a plurality of layers of cardboard;

d. fourthly, inserting said cylinder wrapped with cardboard into a plastic bag with a water tight closure; and e. fifthly, sealing said cylinder with cardboard wrap in a cardboard box, said cardboard box having a closure at either end which shields the top and bottom of said cylinder with a plurality of layers of cardboard, said closure being comprised of four flaps each of which are substantially the same dimension as the end of said box.

15. A method of packaging vials containing diagnostic specimens for purposes of transport, comprising the steps of:

a. firstly, wrapping a vial in shock absorbing bubble wrap material;

b. secondly, inserting said wrapped vial in a plastic cylinder with a pressure tight closure, said closure being able to withstand a pressure of 95 kilopascals for a minimum time duration of 10 minutes, said cylinder being divided into four compartments by a removable insert, each of said compartments being adapted to receive one vial containing a diagnostic specimen, said cylinder having cotton balls as moisture absorbing material lining the bottom of each compartment;

c. thirdly, wrapping the sides of said cylinder with a plurality of layers of cardboard;

d. fourthly, inserting said cylinder wrapped with cardboard into a plastic bag with a water tight closure prior to insertion into said cardboard box; and e. fifthly, sealing said cylinder with cardboard wrap in a cardboard box, said cardboard box having a closure at either end which shields the top and bottom of said cylinder with a plurality of layers of cardboard, said closure being comprised of four flaps each of which are substantially the same dimension as the end of said box.

* * * * *